US011783784B2

(12) United States Patent
Lee

(10) Patent No.: US 11,783,784 B2
(45) Date of Patent: Oct. 10, 2023

(54) DISPLAY DEVICE, DRIVING CIRCUIT AND DRIVING METHOD

(71) Applicant: LG DISPLAY CO., LTD, Seoul (KR)

(72) Inventor: HyunHaeng Lee, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/514,242

(22) Filed: Oct. 29, 2021

(65) Prior Publication Data

US 2022/0199039 A1 Jun. 23, 2022

(30) Foreign Application Priority Data

Dec. 18, 2020 (KR) ..... 10-2020-0178590

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/0278* (2013.01); *G09G 2310/0286* (2013.01); *G09G 2310/0291* (2013.01); *G09G 2310/061* (2013.01); *G09G 2310/08* (2013.01)

(58) Field of Classification Search
CPC ..... G09G 3/3291; G09G 3/3266; G09G 2310/08; G09G 2310/061; G09G 2310/0291; G09G 2310/0286; G09G 2310/0278
See application file for complete search history.

(56) References Cited

U.S. PATENT DOCUMENTS 10,467,975 B2 * 11/2019 Suh ..... G09G 3/3648
2020/0210010 A1 * 7/2020 Kim ..... G06F 3/0412

* cited by examiner

*Primary Examiner* — Kenneth B Lee, Jr.
(74) *Attorney, Agent, or Firm* — POLSINELLI PC

(57) ABSTRACT

A display device, a driving circuit and a driving method with an improved image quality in a sensing process for a characteristic value. In addition, aspects of the present disclosure relate a display device, a driving circuit and a driving method capable of diminishing luminance non-uniformity occurring in a sensing process by sensing a characteristic value for each signal line with the same luminance.

18 Claims, 16 Drawing Sheets

*FIG. 13*

| Gate Line | VGH | Luminance |
|---|---|---|
| GL1 | 5.5V | 8 nit |
| GL2 | 5.8V | 10 nit |
| GL3 | 5.9V | 11 nit |
| GL4 | 5.6V | 9 nit |
| ... | ... | ... |

DISPLAY DEVICE, DRIVING CIRCUIT AND DRIVING METHOD

CROSS-REFERENCE TO RELATED APPLICATION

This application claims priority from Korean Patent Applications No. 10-2020-0178590, filed on Dec. 18, 2020, which is hereby incorporated by reference in its entirety.

BACKGROUND

Field of the Disclosure

The present disclosure relates to a display device, a driving circuit and a driving method with an improved image quality.

Description of the Background

A liquid crystal display (LCD) using liquid crystals and an organic light emitting diode display device using an organic light emitting diode (OLED) are representative as a display device that displays an image using digital data.

Among such display devices, the organic light emitting display devices have superior properties, such as rapid response speeds, high contrast ratios, high emissive efficiency, high luminance, and wide viewing angles, since self-emissive light emitting diodes are used. In this case, the light emitting diode may be implemented with an inorganic material or an organic material.

Such an organic light emitting display device may include organic light emitting diodes disposed in a plurality of subpixels aligned in a display panel, and may control the organic light emitting diodes to emit light by controlling a voltage flowing through the organic light emitting diodes, so as to display an image while controlling luminance of the subpixels.

In such an organic light emitting display device, the light emitting diode and a driving transistor to drive the light emitting diode are disposed in each subpixel defined in the display panel. At this time, there may be deviations in the characteristics of transistors in each subpixel such as threshold voltage or mobility, due to changes over the driving time or different driving times among the subpixels. As a result, luminance deviation (luminance non-uniformity) between subpixels may occur, and image quality may be degraded.

Accordingly, a technology for sensing and compensating a characteristic value of a driving transistor such as a threshold voltage or mobility in the organic light emitting display device has been proposed in order to solve the luminance deviation between subpixels. However, there is a still problem that the luminance non-uniformity of the display image is caused during the sensing and compensation process of the characteristic value.

SUMMARY

Accordingly, the present disclosure provides a display device, a driving circuit and a driving method with an improved image quality in a sensing process for a characteristic value.

In addition, the present disclosure provides a display device, a driving circuit and a driving method capable of diminishing luminance non-uniformity occurring in a sensing process by sensing a characteristic value for each signal line with the same luminance.

According to an aspect, aspects of the present disclosure may provide a display device comprising: a display panel including a plurality of gate lines, a plurality of data lines, and a plurality of subpixels; a gate driving circuit for supplying scan signals to the plurality of gate lines; a data driving circuit for supplying data voltage to the plurality of data lines; and a timing controller for controlling the gate driving circuit and the data driving circuit, and performing a sensing process for a characteristic value targeting at least one of the gate lines to which the scan signals with a first level are supplied among the plurality of gate lines during a first sensing period.

According to an aspect, the gate driving circuit is comprised of a plurality of GIP circuits embedded in a non-display area of the display panel.

According to an aspect, the gate driving circuit includes: a plurality of shift registers for sequentially generating output signals according to a gate clock transmitted through a clock line; and a plurality of buffer circuits for generating the scan signals according to the output signals of the plurality of shift registers.

According to an aspect, the gate driving circuit is configured that one shift register is connected to a plurality of buffer circuits.

According to an aspect, the plurality of shift registers use the output signal of a different shift register or a scan signal from the buffer circuit connected to the different shift register as a gate start pulse.

According to an aspect, a level of the scan signal generated from the buffer circuit is controlled by a resistor connected to the clock line.

According to an aspect, the plurality of buffer circuits connected to one shift register generate the scan signals with two or more different levels.

According to an aspect, the plurality of buffer circuit supplies the scan signal with the first level in a (N+1)th gate line, and the scan signal with a second level different from the first level in a (N+2)th gate line, in case of N-phase driving operation in which the scan signals are sequentially supplied to every N gate lines.

According to an aspect, the sensing process is performed targeting the gate lines to which the scan signals with the second level are supplied during a second sensing period.

According to an aspect, the sensing process for the characteristic value is performed in at least one period of an on-sensing process in which the characteristic value is sensed after a power-on signal is generated and before the plurality of subpixels emit a light, an off-sensing process in which the characteristic value is sensed at a state that a power-off signal is generated and an image displaying process is terminated, or a real-time sensing process in which the characteristic value is sensed for each blank period during a display driving period.

According to an aspect, the sensing process for the characteristic value is performed targeting the gate lines being supplied the scan signals with different levels for each blank period.

According to another aspect, aspects of the present disclosure may provide a driving circuit for supplying scan signals to a display panel in which a plurality of subpixels are disposed, through a plurality of gate lines comprising: a plurality of shift registers for sequentially generating output signals according to a gate clock transmitted through a clock line; and a plurality of buffer circuits connected to one shift register for generating the scan signals with two or more different levels; wherein a sensing process for a characteristic value is performed targeting at least one of the gate lines to which the scan signals with a first level are supplied among the plurality of gate lines during a first sensing period.

According to another aspect, aspects of the present disclosure may provide a driving method of a display device including a display panel in which a plurality of gate lines and a plurality of subpixels are disposed, comprising: supplying scan signals to the plurality of gate lines by a gate driving circuit; performing a first sensing process for a characteristic value targeting at least one of the gate lines to which the scan signals with a first level are supplied among the plurality of gate lines during a first sensing period; and performing a second sensing process for the characteristic value targeting at least one of the gate lines to which the scan signals with a second level are supplied during a second sensing period.

In according to exemplary aspects, it may provide a display device, a driving circuit and a driving method with an improved image quality in a sensing process for a characteristic value.

In according to exemplary aspects, it may provide a display device, a driving circuit and a driving method capable of diminishing luminance non-uniformity occurring in a sensing process by sensing a characteristic value for each signal line with the same luminance.

DESCRIPTION OF DRAWINGS

The above and other features and advantages of the present disclosure will be more clearly understood from the following detailed description, taken in conjunction with the accompanying drawings, in which:

FIG. 13 illustrates an exemplary diagram of VGH values and brightness of the first to fourth gate lines in 4-phase driving operation in the display device according to aspects of the present disclosure;

DETAILED DESCRIPTION

Figure 1:
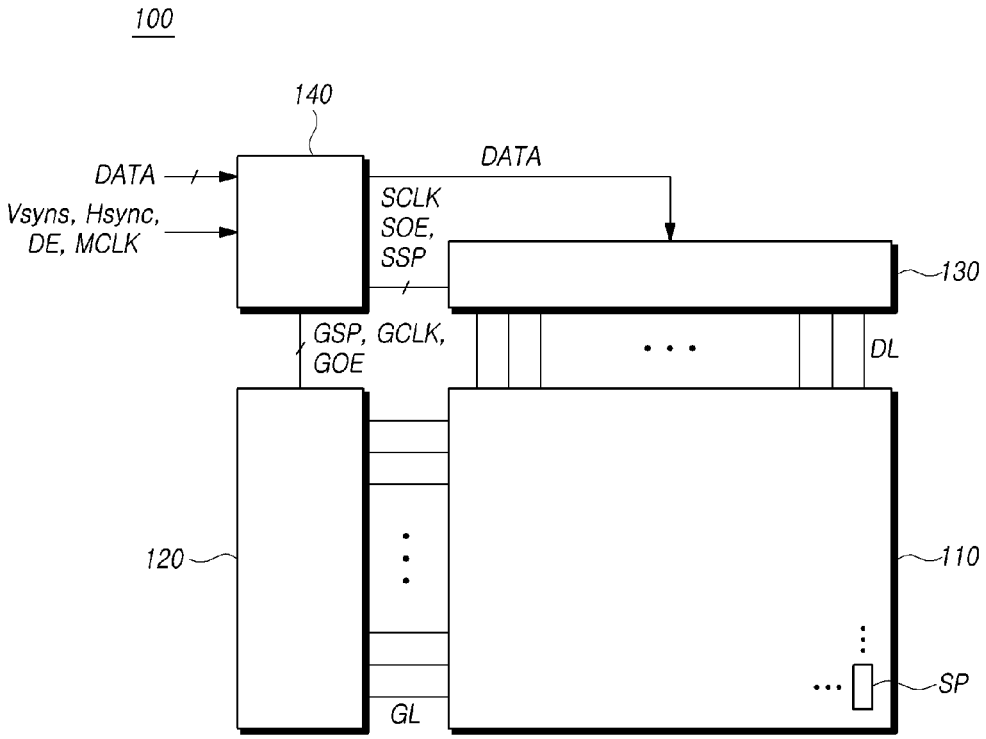
FIG. 1 illustrates a schematic diagram of a display device according to aspects of the present disclosure.

In the following description of examples or aspects of the present disclosure, reference will be made to the accompanying drawings in which it is shown by way of illustration specific examples or aspects that can be implemented, and in which the same reference numerals and signs can be used to designate the same or like components even when they are shown in different accompanying drawings from one another. Further, in the following description of examples or aspects of the present disclosure, detailed descriptions of well-known functions and components incorporated herein will be omitted when it is determined that the description may make the subject matter in some aspects of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after", "subsequent to", "next", "before", and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompass all the meanings of the term "can".

FIG. 1 illustrates a schematic diagram of a display device according to aspects of the present disclosure.

Referring to FIG. 1, the display device 100 according to aspects of the present disclosure may include a display panel 110 connected to a plurality of gate lines GL and a plurality of data lines DL in which a plurality of subpixels SP are arranged in rows and columns, a gate driving circuit 120 for supplying scan signals to the plurality of gate lines GL and a data driving circuit 130 for supplying data voltages to the plurality of data lines DL, and a timing controller 140 for controlling the gate driving circuit 120 and the data driving circuit 130.

The display panel 110 displays an image based on the scan signals supplied from the gate driving circuit 120 through the plurality of gate lines GL and the data voltages supplied from the data driving circuit 130 through the plurality of data lines DL.

In the case of a liquid crystal display, the display panel 110 includes a liquid crystal layer formed between two substrates, and TN (Twisted Nematic) mode, VA (Vertical Alignment) mode, IPS (In Plane Switching) mode, FFS (Fringe Field Switching) mode may be operated in any known mode. In the case of an organic light emitting display, the display panel 110 may be implemented in a top emission method, a bottom emission method, or a dual emission method.

In the display panel 110, a plurality of pixels may be disposed in a matrix form. Each pixel may be composed of subpixels SP of different colors, for example, a white subpixel, a red subpixel, a green subpixel, and a blue subpixel. Each subpixel SP may be defined by the plurality of the data lines DL and the plurality of the gate lines GL.

A subpixel SP may include a thin film transistor (TFT) arranged in a region where a data line DL and a gate line GL intersect, a light emitting element such as an light emitting diode which is emitted according to the data voltage, and a storage capacitor for maintaining the data voltage by being electrically connected to the light emitting element.

For example, when the display device 100 having a resolution of 2,160×3,840 includes four subpixels SP of white W, red R, green G, and blue B, 3,840×4=15,360 data lines DL may be provided by 2,160 gate lines GL and 3,840 data lines DL respectively connected to 4 subpixels WRGB. Each of the plurality of subpixels SP may be disposed in areas in which the plurality of gate lines GL overlap the plurality of data lines DL.

The gate driving circuit 120 is controlled by the timing controller 140, and controls the driving timing of the plurality of subpixels SP by sequentially supplying the scan signals to the plurality of gate lines GL disposed in the display panel 110.

In the display device 100 having a resolution of 2,160×3,840, an operation of sequentially supplying the scan signals to the 2,160 gate lines GL from the first gate line GL1 to the 2,160th gate line GL2160 may be referred to as 2,160-phase driving operation. Otherwise, an operation of sequentially supplying the scan signals to every four gate lines GL, as in a case in which the scan signals are supplied sequentially from first gate line GL1 to fourth gate lines GL4, and then are supplied sequentially from fifth gate line GL5 to eighth gate line GL8, may be referred to as 4-phase driving operation. As described above, an operation in which the scan signals are supplied sequentially to every N number of gate lines may be referred as N-phase driving operation.

The gate driving circuit 120 may include one or more gate driving integrated circuits (GDIC), which may be disposed on one side or both sides of the display panel 110 depending on the driving method. Alternatively, the gate driving circuit 120 may be implemented in a gate-in-panel (GIP) structure embedded in a bezel area of the display panel 110.

The data driving circuit 130 receives digital image data DATA from the timing controller 140, and converts the received digital image data DATA into an analog data voltage. Then, the data driving circuit 130 supplies the analog data voltage to each of the data lines DL at time which the scan signal is supplied through the gate line GL, so that each of the subpixels SP connected to the data lines DL emits light with a corresponding luminance in response to the analog data voltage.

Likewise, the data driving circuit 130 may include one or more source driving integrated circuits (SDIC). Each of the source driving integrated circuits SDIC may be connected to a bonding pad of the display panel 110 by a tape automated bonding (TAB) or a chip on glass (COG), or may be directly mounted on the display panel 110.

In some cases, each of the source driving integrated circuits SDIC may be integrated with the display panel 110. In addition, each of the source driving integrated circuits SDIC may be implemented with a chip on film (COF) structure. In this case, the source driving integrated circuit SDIC may be mounted on circuit film to be electrically connected to the data lines DL in the display panel 110 via the circuit film.

The timing controller 140 supplies various control signals to the gate driving circuit 120 and the data driving circuit 130, and controls the operations of the gate driving circuit 120 and the data driving circuit 130. That is, the timing controller 140 controls the gate driving circuit 120 to supply the scan signals in response to a time realized by respective frames, and on the other hand, transmits the digital image data DATA from an external source to the data driving circuit 130.

Here, the timing controller 140 receives various timing signals, including a vertical synchronization signal Vsync, a horizontal synchronization signal Hsync, a data enable signal DE, and a main clock MCLK, from an external source (e.g., a host system). Accordingly, the timing controller 140 generates control signals using the various timing signals received from the external source, and supplies the control signals to the gate driving circuit 120 and the data driving circuit 130.

For example, the timing controller 140 generates various gate control signals, including a gate start pulse GSP, a gate clock GCLK, and a gate output enable signal GOE, to control the gate driving circuit 120. Here, the gate start pulse GSP is used to control the start timing of one or more gate driving integrated circuits GDIC of the gate driving circuit 120. In addition, the gate clock GCLK is a clock signal commonly supplied to the one or more gate driving integrated circuits GDIC for controlling the shift timing of the scan signals. The gate output enable signal GOE designates timing information of the one or more gate driving integrated circuits GDIC.

In addition, the timing controller 140 generates various data control signals, including a source start pulse SSP, a source sampling clock SSC, and a source output enable signal SOE, to control the data driving circuit 130. Here, the source start pulse SSP is used to control the start timing for the data sampling of one or more source driving integrated circuits SDIC of the data driving circuit 130. The source sampling clock SSC is a clock signal for controlling a timing of data sampling in each of the source driving integrated circuits SDIC. The source output enable signal SOE controls the output timing of the data driving circuit 130.

The display device 100 may further include a power management integrated circuit for supplying or controlling various voltage or current to the display panel 110, the gate driving circuit 120, and the data driving circuit 130.

A light emitting element may be disposed in each of the subpixels SP. For example, the organic light emitting display device may include a light emitting element, such as a light emitting diode in each of the subpixels SP, and may display an image by controlling current flowing through the light emitting elements in response to the data voltage.

Figure 2:
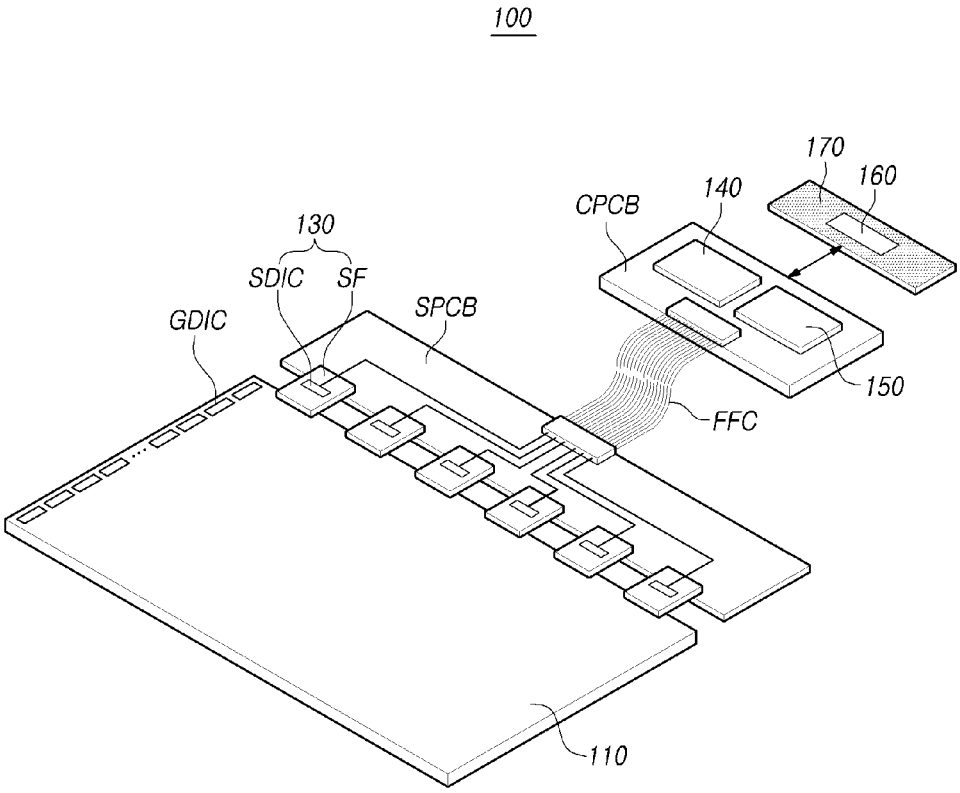
FIG. 2 illustrates a system diagram of the display device according to aspects of the present disclosure.

FIG. 2 illustrates a system diagram of the display device according to aspects of the present disclosure.

As an example, FIG. 2 illustrates that each of the source driving integrated circuits SDIC of the data driving circuit 130 in the display device 100 according to aspects of the present disclosure is implemented with a COF type among various structures among various structures such as a TAB, a COG, and a COF, and the gate driving circuit 120 is implemented with a GIP type among various structures such as a TAB, a COG, a COF, and a GIP.

When the gate driving circuit 120 is implemented in a GIP type, the plurality of gate driving integrated circuits GDIC of the gate driving circuit 120 may be directly formed in a non-display area of the display panel 110. At this time, the gate driving integrated circuits GDIC may receive various signals (e.g., clock signal, gate high signal, gate low signal, etc.) necessary for generating the scan signal through the signal lines related to gate driving operation arranged in the non-display area.

Likewise, the data driving circuit 130 may include one or more source driving integrated circuits SDIC, which may be mounted on a source film SF, respectively. One portion of the source film SF may be electrically connected to the display panel 110. In addition, electrical lines may be disposed on the source films SF to electrically connect the source driving integrated circuits SDIC and the display panel 110.

The display device 100 may include at least one source printed circuit board SPCB in order to connect the plurality of source driving integrated circuits SDIC to other devices by electrical circuit, and a control printed circuit board CPCB in order to mount various control components and electric elements.

The other portion of the source film SF, on which the source driving integrated circuit SDIC is mounted, may be connected to the at least one source printed circuit board SPCB. That is, one portion of source film SF, on which the source driving integrated circuit SDIC is mounted, may be electrically connected to the display panel 110, and the other portion of the source film SF may be electrically connected to the source printed circuit board SPCB.

The timing controller 140 and a power management integrated circuit 150 may be mounted on the control printed circuit board CPCB. The timing controller 140 may control the operations of the data driving circuit 130 and the gate driving circuit 120. The power management integrated circuit 150 may supply a driving voltage and a driving current, or control a voltage and a current for the data driving circuit 130 and the gate driving circuit 120.

At least one source printed circuit board SPCB and the control printed circuit board CPCB may have circuitry connection by at least one connecting member. The connecting member may be, for example, a flexible printed circuit FPC, a flexible flat cable FFC, or the like. At least one source printed circuit board SPCB and the control printed circuit board CPCB may be integrated into a single printed circuit board.

The display device 100 may further include a set board 170 electrically connected to the control printed circuit board CPCB. The set board 170 may also be referred to as a power board. A main power management circuit M-PMC 160 managing overall power of the display device 100 may be located on the set board 170. The main power management circuit 160 may be coupled to the power management integrated circuit 150.

In the display device 100 having the above described configuration, a driving voltage is generated by the set board 170 to be supplied to the power management integrated circuit 150. The power management integrated circuit 150 supplies the driving voltage, which is required for a display driving operation or a sensing operation of the characteristic value, to the source printed circuit board SPCB through the flexible printed circuit FPC or the flexible flat cable FFC. The driving voltage supplied to the source printed circuit board SPCB, is transmitted to emit or sense a specific subpixel SP in the display panel 110 via the source driving integrated circuits SDIC.

Each of the subpixels SP arranged in the display panel 110 of the display device 100 may include a light emitting element and circuit elements, such as a driving transistor to drive it.

The type and number of the circuit elements constituting each of the subpixels SP may be variously determined depending on the function, the design, or the like.

Figure 3:
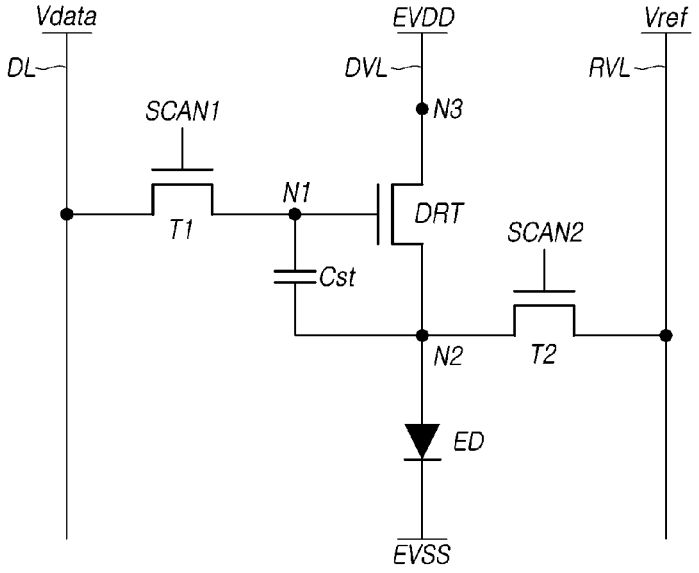
FIG. 3 illustrates a circuit diagram of a subpixel in the display device according to aspects of the present disclosure.

FIG. 3 illustrates a circuit diagram of a subpixel in the display device according to aspects of the present disclosure.

Referring to FIG. 3, each of the subpixels SP arranged in the display device 100 according to aspects of the present disclosure may include one or more transistors, a capacitor, and a light emitting element.

For example, a subpixel SP may include a driving transistor DRT, a first scan transistor T1, a second scan transistor T2, a storage capacitor Cst, and a light emitting diode ED.

The driving transistor DRT may have a first node N1, a second node N2, and a third node N3. The first node N1 of the driving transistor DRT may be a gate node to be supplied a data voltage Vdata through a data line DL when the first scan transistor T1 is turned on.

The second node N2 of the driving transistor DRT may be electrically connected to an anode electrode of the light emitting diode ED, and may be a drain node or a source node.

The third node N3 of the driving transistor DRT may be electrically connected to a driving voltage line DVL to be supplied a driving voltage EVDD, and may be a source node or a drain node.

Here, the driving voltage EVDD for displaying an image may be supplied to the driving voltage line DVL in the display driving period. For example, the driving voltage EVDD for displaying the image may be about 27V.

The first scan transistor T1 is electrically connected between the first node N1 of the driving transistor DRT and the data line DL, and operates in response to a first scan signal SCAN1 supplied thereto through the gate line GL connected to the gate node. In addition, it controls the operation of the driving transistor DRT by transmitting the data voltage Vdata through the data line DL to the gate node of the driving transistor DRT when the first scan transistor T1 is turned on.

The second scan transistor T2 is electrically connected between the second node N2 of the driving transistor DRT and a reference voltage line RVL, and operates in response to a second scan signal SCAN2 supplied through the gate line GL. When the second scan transistor T2 is turned on, a reference voltage Vref supplied from the reference voltage line RVL is transmitted to the second node N2 of the driving transistor DRT.

That is, the voltages of the first node N1 and the second node N2 of the driving transistor DRT may be controlled by controlling the first scan transistor T1 and the second scan transistor T2. Consequently, a current for emitting the light emitting diode ED may be supplied.

Each gate node of the first scan transistor T1 and the second scan transistor T2 may be connected to a single gate line GL or to different gate lines GL. Here, it illustrates an exemplary structure of which the first scan transistor T1 and the second scan transistor T2 are connected to a different gate lines GL. In this case, the first scan transistor T1 and the second scan transistor T2 are controlled independently by the first scan signal SCAN1 and the second scan signal SCAN2 transmitted from the different gate lines GL.

On the other hand, when the first scan transistor T1 and the second scan transistor T2 are connected to single gate line GL, the first scan transistor T1 and the second scan transistor T2 are controlled simultaneously by the first scan signal SCAN1 or the second scan signal SCAN2 transmitted from the single gate line GL, and thus the aperture ratio of the subpixels SP may be improved.

In addition, the transistors disposed in the subpixels SP may be not only n-type transistors, but also p-type transistors. Herein, it illustrates the exemplary structure of the n-type transistors.

The storage capacitor Cst is electrically connected between the first node N1 and the second node N2 of the driving transistor DRT, and serves to maintain the data voltage Vdata during a frame.

Such a storage capacitor Cst may be connected between the first node N1 and the third node N3 of the driving transistor DRT according to a type of the driving transistor DRT. The anode electrode of the light emitting diode ED may be electrically connected to the second node N2 of the driving transistor DRT, and a base voltage EVSS may be supplied to a cathode electrode of the light emitting diode ED.

Here, the base voltage EVSS may be the ground voltage or a voltage higher or lower than the ground voltage. In addition, the base voltage EVSS may be varied depending on the driving condition. For example, the base voltage EVSS during the display driving period may be different from the base voltage EVSS during the sensing period.

The first scan transistor T1 and the second scan transistor T2 may be referred to as scan transistors controlled by the scan signals SCAN1, SCAN2.

The structure of the subpixel SP may further include one or more transistors, or may further include one or more capacitors in some cases.

The display device 100 according to an aspect of the present disclosure may use a method for measuring a current flowing by voltage charged in the storage capacitor Cst during a sensing period of the characteristic value for the driving transistor DRT in order to effectually sense the characteristic value of the driving transistor DRT like threshold voltage or mobility. Such a method may be referred to as a current sensing operation.

That is, the characteristic value or the change of the characteristic value of the driving transistor DRT in the subpixel SP may be determined by measuring the current flowing by voltage charged in the storage capacitor Cst during the sensing period of the characteristic value for the driving transistor DRT.

At this time, the reference voltage line RVL may be referred to as a sensing line since the reference voltage line RVL serves not only to supply the reference voltage Vref but also serves as a sensing line for sensing the characteristic value of the characteristic value for the driving transistor DRT in the subpixel SP.

More specifically, the characteristic value or the change of the characteristic value for the driving transistor DRT may correspond to a difference between the voltage of the gate node and the voltage of the source node of the driving transistor DRT.

The compensation of the characteristic value for the driving transistor DRT may be an internal compensation that is performed by sensing and compensating the characteristic value for the driving transistor DRT within the subpixel SP without using an additional external configuration or may be an external compensation that is performed by sensing and compensating the characteristic value for the driving transistor DRT by using the external compensation circuit.

In this case, the external compensation may be performed before the shipment of the display device 100, and the internal compensation may be performed after the shipment of the display device 100. However, the internal compensation and the external compensation are also performed after the shipment of the display device 100.

Figure 4:
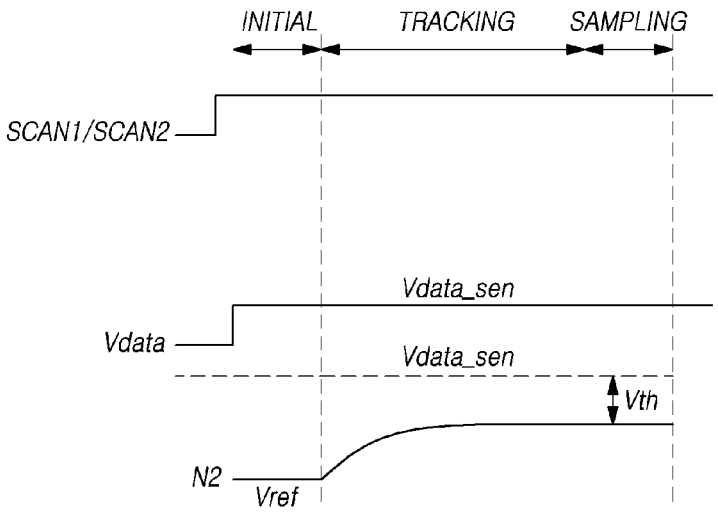
FIG. 4 illustrates a signal timing diagram for sensing a threshold voltage of a driving transistor in the display device according to aspects of the present disclosure.

FIG. 4 illustrates a signal timing diagram for sensing a threshold voltage of a driving transistor in the display device according to aspects of the present disclosure.

Referring to FIG. 4, a sensing process for the threshold voltage Vth of the driving transistor DRT may be comprised of an initializing period INITIAL, a tracking period TRACKING, and a sampling period SAMPLING.

Since the first scan transistor T1 and the second scan transistor T2 are simultaneously turned on and turned off for sensing the threshold voltage Vth of the driving transistor DRT, the first scan signal SCAN1 and the second scan signal SCAN2 may be supplied simultaneously through a gate line GL or the first scan signal SCAN1 and the second scan signal SCAN2 may be supplied at the same time through different gate lines GL.

The initializing period INITIAL is a period to charge the second node N2 of the driving transistor DRT with the reference voltage Vref for sensing the threshold voltage Vth of the driving transistor DRT, and the first scan signal SCAN1 and the second scan signal SCAN2 with a high level may be supplied through the gate line GL.

The tracking period TRACKING is a period to charge the storage capacitor Cst after completing the charge for the second node N2 of the driving transistor DRT.

The sampling period SAMPLING is a period to detect a current flowing by the capacitance charged in the storage capacitor Cst after the storage capacitor Cst of the driving transistor DRT is charged.

In the initializing period INITIAL, the first scan transistor T1 is turned on by supplying simultaneously the first scan signal SCAN1 and the second scan signal SCAN2 with turn-on level. As a result, the first node N1 of the driving transistor DRT is initialized to the data voltage-for-sensing Vdata_sen for sensing the threshold voltage Vth.

In addition, the first scan signal SCAN1 and the second scan signal SCAN2 with a turn-on level cause the second scan transistor T2 to be turned on. In this state, the second node N2 of the driving transistor DRT is initialized to the reference voltage Vref by the reference voltage Vref supplied through the reference voltage line RVL.

The tracking period TRACKING is a period to track the second node N2 of the driving transistor DRT corresponding to the threshold voltage Vth of the driving transistor DRT. In the tracking period TRACKING, the first scan transistor T1 and the second scan transistor T2 are maintained to turn-on level and the reference voltage Vref transmitted through the reference voltage line RVL is blocked.

Accordingly, the second node N2 of the driving transistor DRT is floated, so that the voltage of the second node N2 of the driving transistor DRT is increased from the reference voltage Vref. At this time, since the second scan transistor T2 is turned on, the rising voltage at the second node N2 of the driving transistor DRT leads to the rise of the voltage at the reference voltage line RVL.

In this process, the voltage at the second node N2 of the driving transistor DRT rises and becomes a saturation state. The saturation voltage at the second node N2 of the driving transistor DRT at the saturation state corresponds to the difference (Vdata_sen−Vth) between the data voltage-for-sensing Vdata_sen for sensing the threshold voltage Vth and the threshold voltage Vth of the driving transistor DRT.

In the sampling period SAMPLING, the gate line GL is maintained to the first scan signal SCAN1 and the second scan signal SCAN2 with a high level, and the capacitance charged in the storage capacitor Cst of the driving transistor DRT is sensed by a sensing circuit of characteristic value in the data driving circuit 130.

Figure 5:
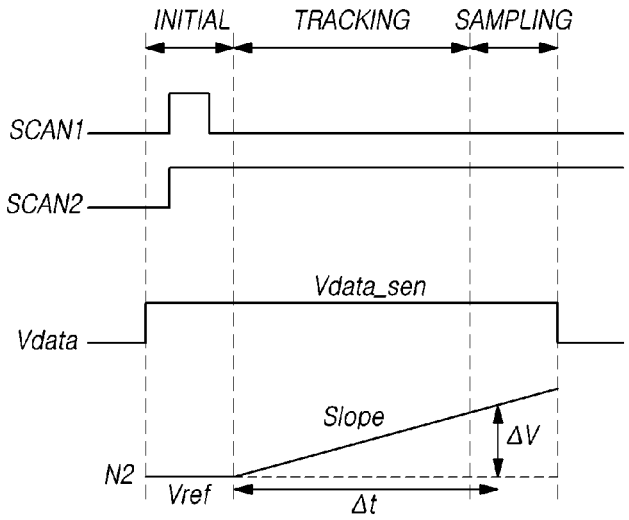
FIG. 5 illustrates a signal timing diagram for sensing a mobility of the driving transistor in the display device according to aspects of the present disclosure.

FIG. 5 illustrates a signal timing diagram for sensing a mobility of the driving transistor in the display device according to aspects of the present disclosure.

Referring to FIG. 5, a sensing process for the mobility of the driving transistor DRT in the display device 100 according to aspects of the present disclosure may be comprised of an initializing period INITIAL, a tracking period TRACKING, and a sampling period SAMPLING like the sensing process for the threshold voltage Vth.

In the initializing period INITIAL, the first scan transistor T1 is turned on by the first scan signal SCAN1 with the turn-on level, so that the first node N1 of the driving transistor DRT is initialized to the data voltage Vdata for sensing the mobility. In addition, the second scan signal SCAN2 with a turn-on level causes the second scan transistor T2 to be turned on. In this state, the second node N2 of the driving transistor DRT is initialized to the reference voltage Vref.

The tracking period TRACKING is a period to track the mobility of the driving transistor DRT. The mobility of the driving transistor DRT may indicate current driving ability of the driving transistor DRT. In the tracking period TRACKING, the voltage at the second node N2 of the driving transistor DRT is tracked for determining the mobility of the driving transistor DRT.

In the tracking period TRACKING, the first scan transistor T1 is turned off by the first scan signal SCAN1 with a turn-off level, and a switch to receive the reference voltage Vref is blocked. Consequently, both the first node N1 and the second node N2 of the driving transistor DRT are floated, so that both the voltage at the first node N1 and the voltage at the second node N2 of the driving transistor DRT are increased.

In particular, since the voltage at the second node N2 of the driving transistor DRT was initialized to the reference voltage Vref, it is increased from the reference voltage Vref. At this time, an increase of the voltage at the second node N2 of the driving transistor DRT causes an increase of the voltage at the reference voltage line RVL, since the second scan transistor T2 is in the turned-on state.

In the sampling period SAMPLING, the sensing circuit for characteristic value in the data driving circuit 130 may detect the voltage of the second node N2 of the driving transistor DRT at a point that a predetermined time Δt has elapsed from the time when the voltage of the second node N2 of the driving transistor DRT starts to increase.

The sensing voltage detected in the sensing circuit for characteristic value may correspond to a voltage (Vref+ΔV) increased from the reference voltage Vref by some voltage ΔV. Accordingly, the mobility of the driving transistor DRT may be determined by using the detected sensing voltage (Vref+ΔV), the known reference voltage Vref, and the increased time Δt of a voltage at the second node N2.

That is, the mobility of the driving transistor DRT is proportional to the voltage variation per unit time ΔV/Δt of the reference voltage line RVL through the tracking period TRACKING and the sampling period SAMPLING. Therefore, the mobility of the driving transistor DRT is proportional to the slope of the voltage in the reference voltage line RVL.

At this time, a compensator in the data driving circuit 130 may compare the mobility determined for the driving transistor DRT to the reference mobility or a mobility of the other driving transistor DRT, and may compensate the deviation of the mobility among the driving transistors DRT. Here, the compensation for the deviation of the mobility may be performed through a logic process of adding or multiplying a compensation value to the digital image data DATA.

As described above, the sensing period for the characteristic value (the threshold voltage or the mobility) of the driving transistor DRT may be proceed after a power-on signal is generated and before the display driving operation is started.

For example, when the power-on signal is supplied to the display device 100, the timing controller 140 loads parameters necessary for driving the display panel 110 and then performs a display driving operation. In this case, the parameters necessary for driving the display panel 110 may include information about the sensing process and compensation process for characteristic value previously performed by the display panel 110. The sensing process for the characteristic value (the threshold voltage or the mobility) of the driving transistor DRT may be performed during the parameter loading process. As described above, the sensing process for the characteristic value during the parameter loading process after the power-on signal is generated may be referred to as an on-sensing process.

Alternatively, the sensing process for the characteristic value of the driving transistor DRT may be performed after the power-off signal for the display device 100 is generated. For example, when the power-off signal is generated in the display device 100, the timing controller 140 may terminate the image display process in the display panel 110, and perform the sensing process for the characteristic value of the driving transistor DRT during a predetermined time. In this way, the sensing process for the characteristic value in a state in which the power-off signal is generated and the image displaying process is terminated may be referred to as an off-sensing process.

In addition, the sensing period for the characteristic value of the driving transistor DRT may be performed in real time while the display driving process is progressed. This sensing process may be referred to as a real-time RT sensing process. In the case of the real-time sensing process, the sensing process may be performed for one or more subpixels SP in one or more subpixel lines for each blank period during the display driving period.

That is, a blank period in which the data voltage is not supplied to the subpixel SP may exist within one frame or between the nth frame and the (n+1)th frame during the display driving period in which an image is displayed on the display panel 110. Accordingly, the sensing process of the mobility for one or more subpixels SP may be performed in the blank period.

As described above, when the sensing process is performed in the blank period, the subpixel SP line on which the sensing process is performed may be randomly selected. Accordingly, abnormal phenomenon that may appear in the display driving period may be diminished after the sensing process in the blank period is performed. In addition, after the sensing process is performed during the blank period, a recovery data voltage may be supplied to the subpixel SP on which the sensing process was performed during the display driving period. Accordingly, abnormal phenomenon in the subpixel SP line for which the sensing process is completed in the display driving period after the sensing process in the blank period may be further diminished.

At this time, since the sensing process for the threshold voltage of the driving transistor DRT may take a long time for saturating the voltage at the second node N2 of the driving transistor DRT, the sensing and compensating process for the threshold voltage Vth is mainly performed in the off-sensing process. On the other hand, since the sensing process for the mobility of the driving transistor DRT takes a relatively short time compared to the sensing process for the threshold voltage Vth, the sensing and compensating process for the mobility may be performed in the real-time sensing process.

In this way, the sensing time of the characteristic value for the subpixels SP in the display device 100 may be determined according to the scan signal SCAN generated by the gate driving circuit 120.

Figure 6:
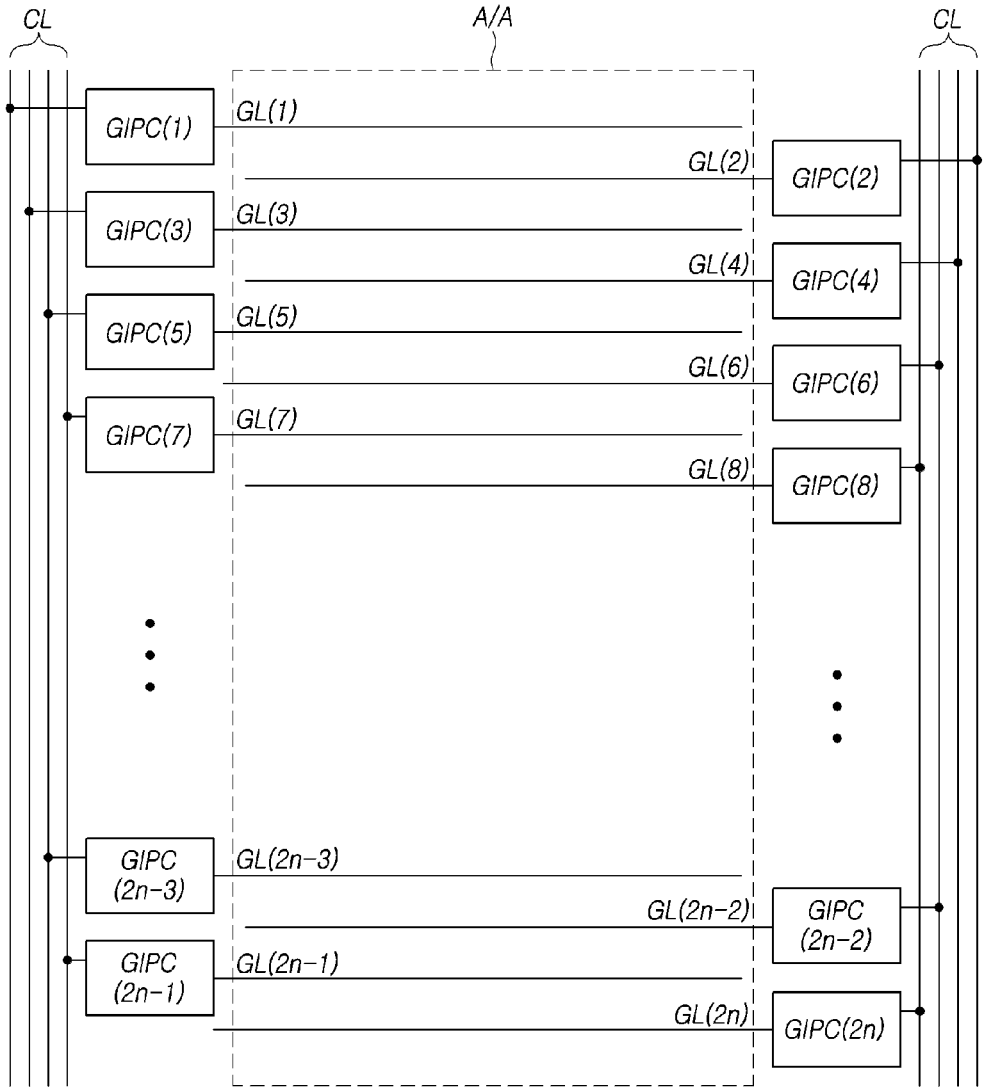
FIG. 6 illustrates a diagram of a display panel in which a gate driving circuit is implemented in a GIP type in the display device according to aspects of the present disclosure.

FIG. 6 illustrates a diagram of a display panel in which a gate driving circuit is implemented in a GIP type in the display device according to aspects of the present disclosure.

Referring to FIG. 6, the display device 100 according to aspects of the present disclosure may include 2n gate lines GL1-GL(2n) (n is a natural number) in a display area A/A for displaying an image on the display panel 110.

In this case, the gate driving circuit 120 may be disposed in a non-display area corresponding to the outside of the display area A/A of the display panel 110, and may include 2n GIP circuits GIPC matched to the 2n gate lines GL(1)-GL(2n) with each other.

Accordingly, the 2n GIP circuits GIPC may supply the scan signals SCAN to the 2n gate lines GL(1)-GL(2n).

As described above, when the gate driving circuit 120 is implemented in a GIP type, there is no need to manufacture a separate integrated circuit having a gate driving function and bond it to the display panel 110. As a result, it is possible to reduce the number of integrated circuits and omit the connecting process of the integrated circuit to the display panel 110. In addition, the size of the bezel area for bonding the integrated circuit in the display panel 110 may be reduced.

It may describe the 2n GIP circuits GIPC as GIP(1), GIP(2), . . . , GIP(2n) in order to distinguish the 2n GIP circuits GIPC from each other and to identify a relation with the 2n gate lines GL(1)-GL(2n).

Here, it illustrates a case where 2n GIP circuits GIPC(1)-GIPC(2n) are divided and arranged on both sides of the display area A/A. For example, odd-numbered GIP circuits GIPC(1), GIPC(3), . . . , GIPC(2n−1) among the 2n GIP circuits GIPC(1)-GIPC(2n) may drive odd-numbered gate lines GL(1), GL(3), . . . , GL(2n−1). Also, even-numbered GIP circuits GIPC(2), GIPC(4), . . . , GIPC(2n) may drive even-numbered gate lines GL(2), GL(4), . . . , GL(2n).

Alternatively, the 2n GIP circuits GIPC(1)-GIPC(2n) may be disposed only on one side of the display area A/A.

A plurality of clock line CL in order to supply gate clocks required for generating and supplying the scan signal SCAN to the gate driving circuit 120 may be disposed in the non-display area corresponding to the outside of the display area A/A of the display panel 110.

Figure 7:
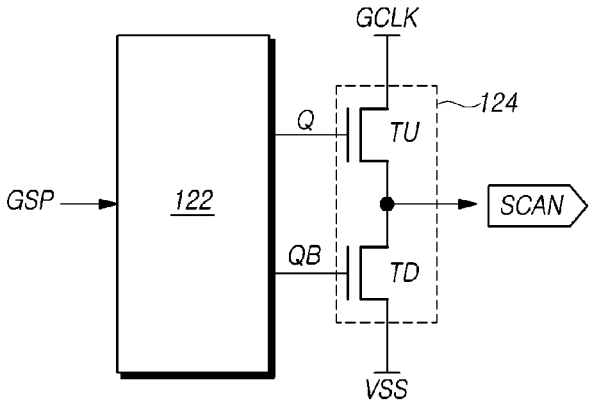
FIG. 7 illustrates a schematic diagram of a GIP circuit in the display device according to aspects of the present disclosure.

FIG. 7 illustrates a schematic diagram of a GIP circuit in the display device according to aspects of the present disclosure.

Referring to FIG. 7, a GIP circuit GIPC may include a shift register 122 and a buffer circuit 124 in the display device 100 according to aspects of the present disclosure.

The GIP circuit GIPC operates according to the gate start pulse GSP and generates the scan signals SCAN according to the gate clock GCLK. The scan signals SCAN generated from the GIP circuit GIPC are sequentially shifted and sequentially supplied through the gate lines GL.

The buffer circuit 124 may have two nodes Q, QB that are important for a gate driving state, and may include a pull-up transistor TU and a pull-down transistor TD. Here, a gate node of the pull-up transistor TU may correspond to the Q node, and a gate node of the pull-down transistor TD may correspond to the QB node.

The shift register 122 may be referred to as a shift logic circuit, and may be used to generate the scan signal SCAN in synchronization with the gate clock GCLK.

The shift register 122 may include a plurality of transistors and control the Q node and the QB node connected to the buffer circuit 124 so that the buffer circuit 124 may generate the scan signal SCAN.

The scan signals SCAN may be generated by sequentially turning on the output of the shift register 122 according to the gate clock GCLK. That is, a logic state for determining on/off of the gate line GL may be sequentially supplied to the buffer circuit 124 by controlling the output time of the shift register 122 using the gate clock GCLK.

Each voltage state of the Q node and the QB node of the buffer circuit 124 may be changed by the shift register 122. Accordingly, the buffer circuit 124 may supply a voltage (e.g., the voltage may have a high level voltage or a low level voltage, for example, a clock signal with a gate high level voltage VGH) for turning on the corresponding gate line GL, or may supply a voltage (e.g., the voltage may have a low level voltage or a high level voltage, for example, a base voltage VSS with a gate low level voltage VGL) for turning off the corresponding gate line GL.

Meanwhile, a GIP circuit GIPC may further include a level shifter in addition to the shift register 122 and the buffer circuit 124.

In this case, the shift register 122 and the buffer circuit 124 constituting the GIP circuit GIPC may be connected in various structures.

Figure 8:
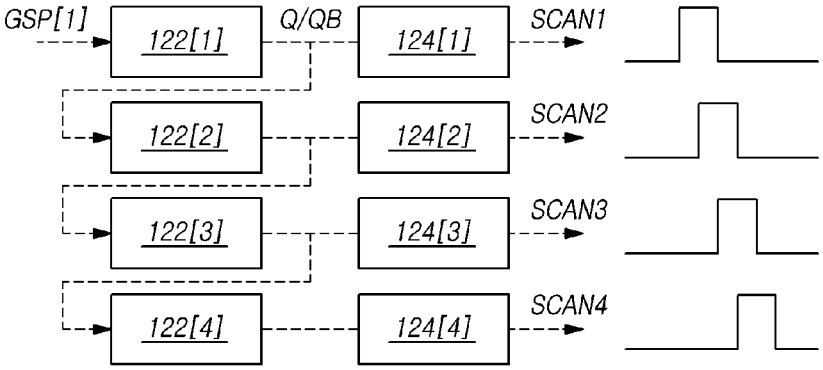
FIGS. 8 and 9 illustrate a diagram showing the configuration of the GIP circuit in the display device according to aspects of the present disclosure.
Figure 9:
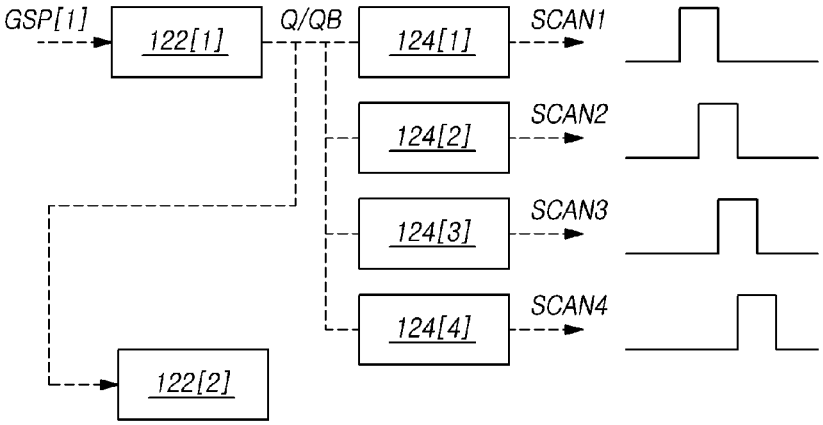

FIGS. 8 and 9 illustrate a diagram showing the configuration of the GIP circuit in the display device according to aspects of the present disclosure.

Referring to FIGS. 8 and 9, the shift register 122 constituting the GIP circuit GIPC in the display device 100 according to aspects of the present disclosure may be configured to numbers same as a plurality of buffer circuits 124 connected to the gate line GL or may be configured for one shift register 122 to be connected to a plurality of buffer circuits 124.

In FIG. 8, it illustrates a case that a plurality of shift registers 122[1]-122[4] constituting a GIP circuit GIPC are connected to a plurality of buffer circuits 124[1]-124[4] connected to a gate line GL in a 1:1 relationship. In FIG. 9, it illustrates a case that a shift register 122[1] is connected in parallel to a plurality of buffer circuits 124[1]-124[4] connected to the gate line GL.

At this time, the first shift register 122[1] of the GIP circuit GIPC starts operation by the gate start pulse GSP, and the second shift register 122[2] to the fourth shift register 122[4] may use a carry signal supplied from a shift register in a previous stage as the gate start pulse GSP.

In this case, the carry signal used as the gate start pulse GSP may be a signal at a Q node or a QB node of a shift register in a previous stage, or may be a scan signal SCAN transmitted from the buffer circuit 124. Here, it illustrates a case as an example where the signal at the Q node or the QB node of the shift register in the previous stage is used as the gate start pulse GSP.

In the case of FIG. 8, the first shift register 122[1] starts an operation by a first gate start pulse GSP[1]. Also, the second shift register 122[2] to the fourth shift register 122[4] are cascaded in series to generate scan signals SCAN1-SCAN4 by using the signal at the Q node or the QB node in the previous stage as a carry signal.

In the case of FIG. 9, the first shift register 122[1] is connected in parallel to the first buffer circuit 124[1] to the fourth buffer circuit 124[4], and starts an operation by the first gate start pulse GSP[1].

As described above, it is possible to reduce the bezel area of the display panel 110 by narrow area of the shift register 122[1] if the first buffer circuit 124[1] to the fourth buffer circuit 124[4] are connected to a shift register 122[1].

Figure 10:
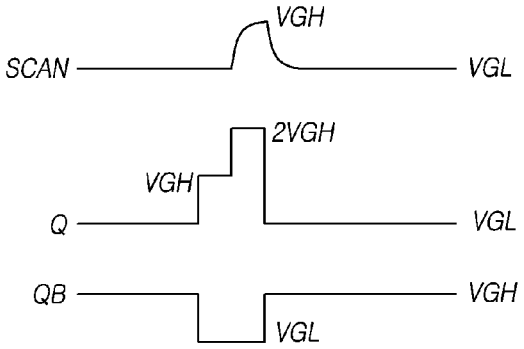
FIG. 10 illustrates signal waveforms of a shift register and a buffer circuit of the GIP circuit in the display device according to aspects of the present disclosure.

FIG. 10 illustrates signal waveforms of a shift register and a buffer circuit of the GIP circuit in the display device according to aspects of the present disclosure.

Referring to FIG. 10, the GIP circuit GIPC in the display device 100 according to aspects of the present disclosure may include a shift register 122 for charging and discharging the Q node and the QB node, and a buffer circuit 124 for generating the scan signal SCAN according to voltages of the Q node and the QB node.

The shift register 122 charges the Q node, which is charged opposite to the QB node, by receiving the gate start pulse GSP or the carry signal transmitted from the previous stage.

The buffer circuit 124 may include the pull-up transistor TU which is turned-on by the Q node voltage of the shift register 122 to charge the output node with a voltage of the gate clock GCLK, and the pull-down transistor TD which is turned on by the Q node voltage to discharge the output node. The scan signal SCAN generated through the above process is supplied to the display panel 110 through the gate line GL.

At this time, the pull-up transistor TU may additionally charge the output node to the voltage of the gate clock GCLK while the gate clock GCLK is supplied in the state that the Q node was charged to the gate high level voltage VGH.

Accordingly, the voltage of the floated Q node is bootstrapped and the gate high level voltage VGH rises to an accumulated level (about 2 VGH) while the gate clock GCLK is supplied to the pull-up transistor TU. In this way, the pull-up transistor TU is turned on and the voltage of the output node rises to 1 gate high level voltage VGH when the Q node voltage rises to about 2 gate high level voltage 2VGH.

On the other hand, when the QB node voltage is charged to the gate high level voltage VGH, the scan signal SCAN may be discharged to the gate low level voltage VGL by connecting the output node to the base voltage VSS to which the gate low level voltage VGL is supplied.

At this time, in the case of N-phase driving operation that sequentially supplies the scan signals SCAN for every N gate lines GL, the Q node voltage of the shift register 122 may rise to about 4 gate high level voltage 4VGH, and the level of the scan signal SCAN transmitted through the gate line GL is different from the level of the gate clock GCLK due to the fluctuation of the Q node voltage.

Figure 11:
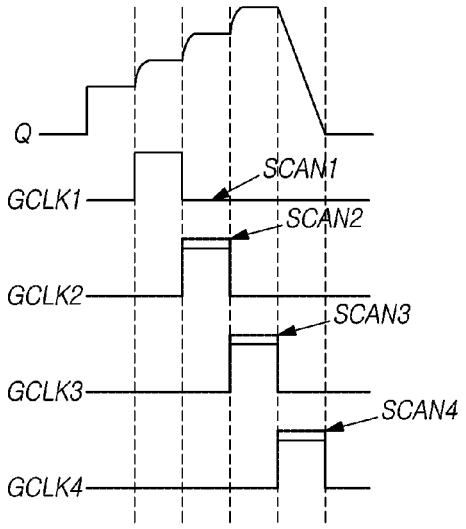
FIG. 11 illustrates a signal waveform diagram showing a case in which levels of a gate clock and a scan signal are changed by a Q node voltage of the shift register in the display device according to aspects of the present disclosure.

FIG. 11 illustrates a signal waveform diagram showing a case in which levels of a gate clock and a scan signal are changed by a Q node voltage of the shift register in the display device according to aspects of the present disclosure.

Referring to FIG. 11, while the Q node of the first shift register 122[1] is charged to the gate high level voltage VGH, a voltage at the floated Q node of the pull-up transistor TU of the GIP circuit GIPC in the display device 100 according to aspects of the present disclosure is bootstrapped and thus the gate high level voltage VGH at the Q node rises to the accumulated level of about 2 gate high level voltage 2VGH when the first gate clock GCLK1 is supplied to the first buffer circuit 124[1].

In this case, the first scan signal SCAN1 supplied to the first gate line GL1 from the first buffer circuit 124[1] may maintain the same level as the first gate clock GCLK1.

Thereafter, the Q node voltage rises to about 3 gate high level voltage 3VGH when the second gate clock GCLK2 is supplied to the second buffer circuit 124[2]. Also, the second scan signal SCAN2 supplied to the second gate line GL2 from the second buffer circuit 124[2] rises to a level higher than the second gate clock GCLK2 by the Q node voltage (about 2VGH) in the previous stage.

Similarly, the third scan signal SCAN3 supplied to the third gate line GL3 from the third buffer circuit 124[3] also rises to a level higher than the third gate clock GCLK3 by the Q node voltage (about 3VGH) in the previous stage. Also, the fourth scan signal SCAN4 supplied to the fourth gate line GL4 from the fourth buffer circuit 124[4] rises to a level higher than the fourth gate clock GCLK4 by the Q node voltage (about 4VGH) in the previous stage.

In the case of 4-phase driving operation in which the scan signals SCAN1-SCAN4 are sequentially supplied to every four gate lines GL1-GL4, each level of the scan signals SCAN1-SCAN4 supplied to the first gate line GL1 to the fourth gate line GL4 may have different values.

Figure 12:
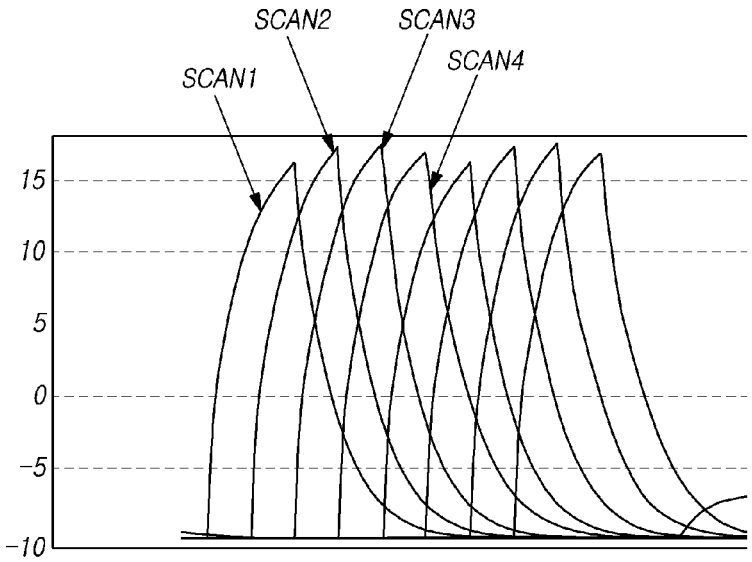
FIG. 12 illustrates a signal waveform diagram showing a case in which the levels of the scan signals supplied to the first to fourth gate lines are different in 4-phase driving operation in the display device according to aspects of the present disclosure.

FIG. 12 illustrates a signal waveform diagram showing a case in which the levels of the scan signals supplied to the first to fourth gate lines are different in 4-phase driving operation in the display device according to aspects of the present disclosure, and FIG. 13 illustrates an exemplary diagram of VGH values and brightness of the first to fourth gate lines in 4-phase driving operation in the display device according to aspects of the present disclosure.

Referring to FIGS. 12 and 13, in the case of N-phase driving operation in which the scan signals SCAN are sequentially supplied to every N gate lines GL, the level of the N scan signals SCAN supplied to the N gate lines GL may be changed for each gate line GL.

As described above, when the scan signals SCAN supplied through the gate line GL have different level, the voltage coupled to the gate node of the driving transistor DRT constituting the subpixel SP becomes different and thus, a light emitting luminance of the subpixel SP corresponding to each gate line GL is deviated.

This is a problem from a reason that the Q node level of the GIP circuit GIPC is sequentially increased owing to a phenomenon that the gate clock GCLK causes the scan signals SCAN sequentially supplied to the N adjacent gate lines GL to overlap each other in some period.

In order to solve the problem, the scan signals SCAN supplied to the gate lines GL may be kept at the same level by lowering the level of the gate clock GCLK supplied to some buffer circuits 124 of the GIP circuit GIPC. In this case, the level of the gate clock GCLK may be controlled by varying a resistance value connected to the clock line CL to which the gate clock GCLK is supplied.

For example, a first resistor with a first value may be connected to the gate clock GCLK line of the first GIP circuit GIPC(1) in which the first scan signal SCAN1 with a first level is generated. A second resistor with a second value may be connected to the gate clock GCLK line of the second GIP circuit GIPC(2) in which the second scan signal SCAN2 with a second value is generated. A third resistor with a third value may be connected to the gate clock GCLK line of the third GIP circuit GIPC(3) in which the third scan signal SCAN3 with a third value is generated. And, a fourth resistor with a fourth value may be connected to the gate clock GCLK line of the fourth GIP circuit GIPC(4) in which the fourth scan signal SCAN4 with a fourth value is generated.

In this case, the levels of the first resistor and the second resistor will be different when the levels of the first scan signal SCAN1 and the second scan signal SCAN2 are different from each other.

On the other hand, in the case of N-phase driving operation that the scan signals SCAN are sequentially supplied to every N gate lines GL, the scan signals SCAN(4N+1) of the 4N+1 gate line GL(4N+1) disposed at every (N+1)th position may have same level. In this case, the resistance connected to the gate clock GCLK may have the same value for every 4N+1 gate line GL (4N+1).

Meanwhile, as described above, the display device 100 according to aspects of the present disclosure may perform the operation for sensing and compensating the characteristic value of the driving transistor DRT within a frame during display driving period, or within a blank period between the nth frame and the (n+1)th frame.

Figure 14:
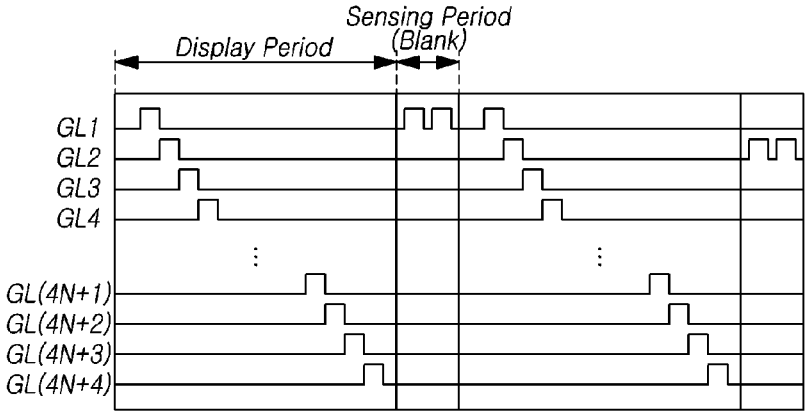
FIG. 14 illustrates an exemplary signal waveform diagram of the scan signals during a display period and a sensing period in the display device according to aspects of the present disclosure.

FIG. 14 illustrates an exemplary signal waveform diagram of the scan signals during a display period and a sensing period in the display device according to aspects of the present disclosure.

Referring to FIG. 14, the display device 100 according to aspects of the present disclosure may display an image in the display panel 110 by sequentially supplying the scan signals SCAN to the plurality of gate lines GL1-GL(4N+4) during a display driving period Display Period and may sense the characteristic value of the driving transistor DRT disposed in a selected subpixel SP in the blank period.

Accordingly, the blank period for sensing the characteristic value of the driving transistor DRT disposed in the subpixel SP may be referred to as a sensing period Sensing Period.

At this time, the scan signals SCAN may be sequentially supplied to the plurality of gate lines GL1-GL(4N+4) in the display driving period Display Period. As described above, in the case of the N-phase driving operation in which the scan signals SCAN are sequentially supplied to every N gate lines GL, the N gate lines GL may be determined as a scan unit.

Accordingly, the subpixels SP may be emitted by sequentially supplying the scan signals SCAN to the N gate lines GL corresponding to the scan unit, and then the scan signals SCAN are sequentially supplied to next N gate lines GL corresponding to the scan unit.

On the other hand, the sensing operation of the characteristic value is performed by selecting an arbitrary subpixel SP connected to an arbitrary gate line GL in the blank period.

As described above, since the gate line GL to which the scan signal SCAN is applied is different between the display driving period for displaying an image and the blank period (sensing period) in which the image is not displayed, the Q node voltage of the shift register 122 constituting the GIP circuit GIPC is changed.

Figure 15:
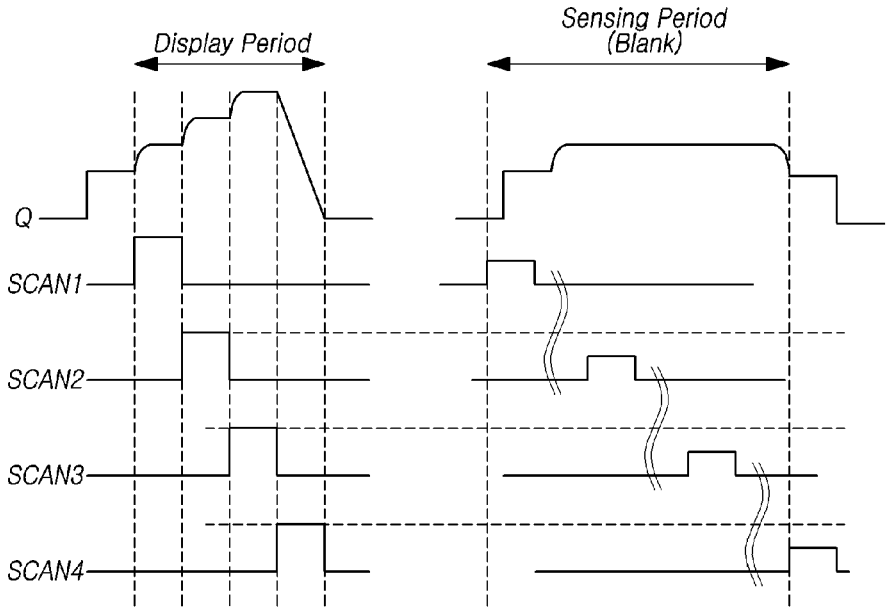
FIG. 15 illustrates an exemplary diagram of the Q node voltage and scan signals in the display period and the sensing period in the display device according to aspects of the present disclosure.

FIG. 15 illustrates an exemplary diagram of the Q node voltage and scan signals in the display period and the sensing period in the display device according to aspects of the present disclosure.

Referring to FIG. 15, as the Q node voltage of the shift register 122 constituting the gate driving circuit 120 or the GIP circuit GIPC in the display device 100 according to aspects of the present disclosure rises during the display driving period Display Period for displaying an image, the level of the scan signal SCAN supplied through the gate line GL may be increased rather than the gate clock GCLK.

On the other hand, since the gate line GL may be arbitrarily selected for sensing the characteristic value in the sensing period Sensing Period for sensing the characteristic value, the Q node voltage of the shift register 122 constituting the GIP circuit GIPC in the sensing period Sensing Period becomes different from the Q node voltage in the display driving period Display Period.

Accordingly, the high level of the scan signal SCAN supplied to selected gate line GL during the sensing period Sensing Period becomes different from the high level of the scan signal SCAN supplied to the gate line GL during the display driving period Display Period.

At this time, if the gate line GL is arbitrarily selected for sensing the characteristic value during the sensing period Sensing Period, each of the high level of the scan signal SCAN supplied to selected gate line GL may be different. Therefore, whenever the gate line GL to which the scan signal SCAN is supplied is changed during the sensing period for the characteristic value, a flicker may occur due to a different luminance.

In this way, in order to solve the luminance non-uniformity that may occur during the sensing period Sensing Period for the characteristic value, the display device 100 according to aspects of the present disclosure may reduce the flicker due to the luminance deviation by performing the sensing operation for the characteristic value targeting the gate lines GL with the same luminance during a certain sensing period Sensing Period.

Figure 16:
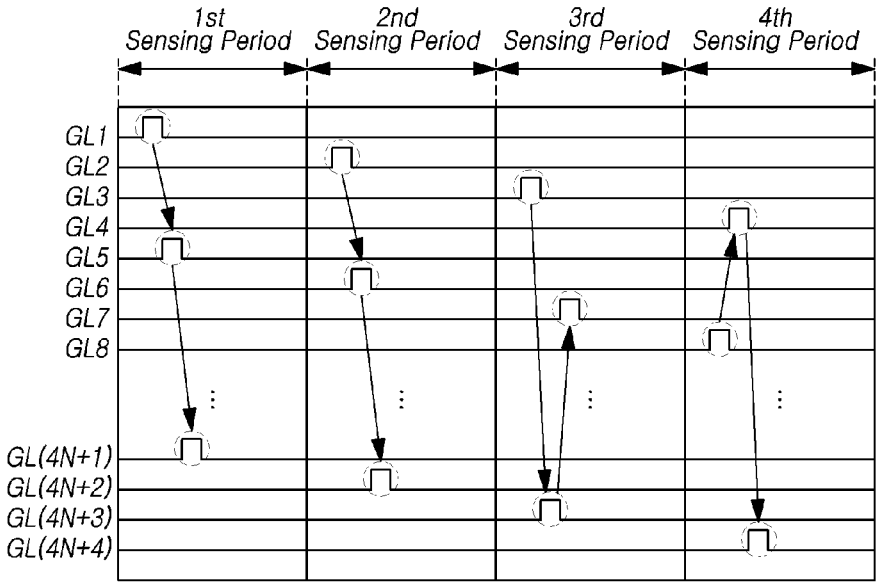
FIG. 16 illustrates a diagram conceptually showing a method of selecting gate lines for sensing a characteristic value during the sensing period in the display device according to aspects of the present disclosure.

FIG. 16 illustrates a diagram conceptually showing a method of selecting gate lines for sensing a characteristic value during the sensing period in the display device according to aspects of the present disclosure.

Referring to FIG. 16, the display device 100 according to aspects of the present disclosure may divide a plurality of sensing periods for sensing characteristic value of the driving transistor DRT disposed in the subpixel SP, and senses the characteristic value for the gate lines GL having the same luminance within a same sensing period. So that, it is possible to reduce the luminance non-uniformity occurring during the sensing operation for the characteristic value.

For example, in the case of 4-phase driving operation in which the scan signals SCAN are sequentially supplied to every four gate lines GL, the real-time sensing process for sensing of the characteristic value of the driving transistor DRT in the blank period may be performed to sense the characteristic value targeting the gate lines GL1, GL5, . . . , GL(4N+1) with a first luminance during a first sensing period 1st Sensing Period, and may be performed to sense the characteristic value targeting the gate lines GL2, GL6, . . . , GL(4N+2) with a second luminance during a second sensing period 2nd Sensing Period which is different from the first sensing period. In addition, the real-time sensing process for sensing of the characteristic value of the driving transistor DRT in the blank period may be performed to sense the characteristic value targeting the gate lines GL3, GL7, . . . , GL(4N+3) with a third luminance during a third sensing period 3rd Sensing Period which is different from the second sensing period, and may be performed to sense the characteristic value targeting the gate lines GL4, GL8, . . . , GL(4N+4) with a fourth luminance during a fourth sensing period 4th Sensing Period which is different from the third sensing period.

In this case, the gate lines GL selected for sensing the characteristic value during one sensing period may be gate lines GL with the same luminance, and the order of the gate lines GL selected for sensing the characteristic value may not be constant.

For example, the gate lines GL1, GL5, . . . , GL(4N+1) with the same luminance sensed in the first sensing period may be sequentially selected from a upper portion to a lower portion of the display panel 110, but the gate lines GL3, GL7, . . . , GL(4N+3) with the same luminance sensed in the third sensing period may be selected in various sequences from a upper portion, a lower portion, or a central portion of the display panel 110.

As described above, the flicker due to the luminance deviation may be diminished by performing the sensing process for the characteristic value targeting the gate lines GL with the same luminance during one sensing period in which the characteristic value are sensed.

The above description has been presented to enable any person skilled in the art to make and use the technical idea of the present disclosure, and has been provided in the context of a particular application and its requirements. Various modifications, additions and substitutions to the described aspects will be readily apparent to those skilled in the art, and the general principles defined herein may be applied to other aspects and applications without departing from the spirit and scope of the present disclosure. The above description and the accompanying drawings provide an example of the technical idea of the present disclosure for illustrative purposes only. That is, the disclosed aspects are intended to illustrate the scope of the technical idea of the present disclosure. Thus, the scope of the present disclosure is not limited to the aspects shown, but is to be accorded the widest scope consistent with the claims. The scope of protection of the present disclosure should be construed based on the following claims, and all technical ideas within the scope of equivalents thereof should be construed as being included within the scope of the present disclosure.

What is claimed is:

1. A display device comprising:

a display panel including a plurality of gate lines, a plurality of data lines, and a plurality of subpixels;

a gate driving circuit for supplying scan signals to the plurality of gate lines;

a data driving circuit for supplying data voltage to the plurality of data lines; and a timing controller for controlling the gate driving circuit and the data driving circuit and performing a sensing process having a first sensing period for a characteristic value targeting gate lines to which the scan signals with a first high level and a first low level are supplied among the plurality of gate lines and a second sensing period for a characteristic value targeting gate lines to which the scan signals with a second high level and a second low level are supplied among the plurality of gate lines, wherein the first high level is different from the second high level.

2. The display device according to claim 1, wherein the gate driving circuit is comprised of a plurality of GIP circuits embedded in a non-display area of the display panel.

3. The display device according to claim 1, wherein the gate driving circuit includes:

a plurality of shift registers for sequentially generating output signals according to gate clocks transmitted through clock lines; and a plurality of buffer circuits for generating the scan signals according to the output signals of the plurality of shift registers.

4. The display device according to claim 3, wherein the gate driving circuit is configured that one shift register is connected to a plurality of buffer circuits.

5. The display device according to claim 3, wherein the plurality of shift registers use the output signal of a different shift register or a scan signal from a buffer circuit among the plurality of buffer circuits that is connected to the different shift register as a gate start pulse.

6. The display device according to claim 3, wherein a level of the scan signal generated from one of the plurality of buffer circuits is controlled by a resistor connected to one of the clock lines that is connected to the one of the plurality of buffer circuits.

7. The display device according to claim 3, wherein the plurality of buffer circuits supply the scan signal with the first high level in an N th gate line in the sensing process, and the scan signal with the second high level different from the first high level in in the sensing process, wherein N is a positive integer.

8. The display device according to claim 1, wherein the sensing process for the characteristic value is performed in at least one period of an on-sensing process in which the characteristic value is sensed after a power-on signal is generated and before the plurality of subpixels emit a light, an off-sensing process in which the characteristic value is sensed at a state that a power-off signal is generated and an image displaying process is terminated, or a real-time sensing process in which the characteristic value is sensed for each blank period during a display driving period.

9. The display device according to claim 8, wherein the sensing process for the characteristic value is performed targeting the gate lines being supplied the scan signals with different levels for each blank period.

10. A driving circuit for supplying scan signals to a display panel in which a plurality of subpixels are disposed, through a plurality of gate lines comprising:

a plurality of shift registers for generating output signals according to gate clocks transmitted through clock lines; and a plurality of buffer circuits connected to one shift register for generating the scan signals with two or more different levels;

wherein a sensing process for a characteristic value is performed targeting at least one of the gate lines to which the scan signals with a first level are supplied among the plurality of gate lines during a first sensing period.

11. The driving circuit according to claim 10, wherein the plurality of shift registers use output signals of different shift registers or the scan signals from the buffer circuits connected to the different shift registers as a gate start pulse.

12. The driving circuit according to claim 10, wherein the plurality of buffer circuit supplies the scan signal with the first level in a (N+1)th gate line, and the scan signal with a second level different from the first level in a (N+2)th gate line.

13. The driving circuit according to claim 12, wherein the sensing process is performed targeting gate lines to which the scan signals with the second level are supplied during a second sensing period.

14. The driving circuit according to claim 10, wherein a level of the scan signal generated from the plurality of buffer circuits is controlled by a resistor connected to the clock lines.

15. A driving method of a display device including a display panel in which a plurality of gate lines and a plurality of subpixels are disposed, comprising:

supplying scan signals to the plurality of gate lines by a gate driving circuit;

performing a first sensing process for a characteristic value targeting gate lines to which the scan signals with a first high level and a first low level are supplied among the plurality of gate lines during a first sensing period; and performing a second sensing process for the characteristic value targeting gate lines to which the scan signals with a second high level and a second low level are supplied among the plurality of gate lines during a second sensing period, wherein the first high level is different from the second high level.

16. A driving method of a display device according to claim 15, wherein the sensing process for the characteristic value is performed in at least one period of an on-sensing process in which the characteristic value is sensed after a power-on signal is generated and before the plurality of subpixels emit a light, an off-sensing process in which the characteristic value is sensed at a state that a power-off signal is generated and an image displaying process is terminated, or a real-time sensing process in which the characteristic value is sensed for each blank period during a display driving period.

17. A driving method of a display device according to claim 16, wherein the sensing process for the characteristic value is performed targeting the gate lines being supplied the scan signals with different levels for each blank period.

18. The display device according to claim 1, wherein the timing controller controls for performing a display process, in which scan signals having substantially same level are sequentially applied to the plurality of gate lines.

* * * * *